United States Patent [19]

Grammatica

[11] 4,314,012

[45] Feb. 2, 1982

[54] PHOTOCONDUCTIVE REFLEX EXPOSURE MEMBER

[75] Inventor: Steven J. Grammatica, Fairport, N.Y.

[73] Assignee: Xerox Corporation, Stamford, Conn.

[21] Appl. No.: 182,173

[22] Filed: Aug. 27, 1980

[51] Int. Cl.[3] ..... G03C 5/10; G03G 5/10; G03G 5/14

[52] U.S. Cl. ..... 430/31; 430/60; 430/64; 430/72; 430/73; 430/83; 430/395

[58] Field of Search ..... 430/60, 72, 73, 83, 430/395, 31

[56] References Cited

U.S. PATENT DOCUMENTS

| | | | |
|---|---|---|---|
| 2,917,385 | 12/1959 | Byrne | 96/1 |
| 3,671,233 | 6/1972 | Confuis | 96/1.6 |
| 3,679,406 | 7/1972 | Kryman | 430/73 X |
| 4,078,925 | 3/1978 | Horgan | 96/1 PC |

FOREIGN PATENT DOCUMENTS

| | | | |
|---|---|---|---|
| 644167 | 7/1962 | Canada | 430/31 |
| 893011 | 4/1962 | United Kingdom | 430/31 |
| 1093596 | 12/1967 | United Kingdom | 430/31 |

*Primary Examiner*—John D. Welsh
*Attorney, Agent, or Firm*—E. O. Palazzo

[57] ABSTRACT

A reflex exposure imaging member including a transparent conductive support member and a photoconductive layer disposed on said support member and an optical screen disposed between the photoconductive layer and the support member wherein the photoconductive layer includes an N,N'-diphenyl, N,N'-substituted diphenylbenzidine compound and a pyrylium, thiapyrylium or selenapyrylium salt in an insulating binder, the photoconductive layer having a thickness of about 5 to about 20 microns and an optical density of from about 0.1 to about 0.8.

16 Claims, 1 Drawing Figure

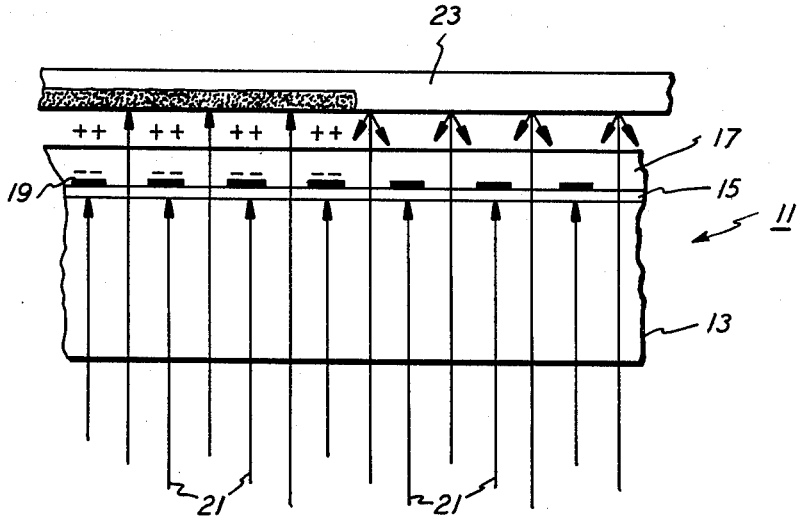
23
17
19
15
11
13
21
21

PHOTOCONDUCTIVE REFLEX EXPOSURE MEMBER

BACKGROUND OF THE INVENTION

This invention relates to a reflex exposure imaging member and, more particularly, to a reflex exposure imaging member having a particular composition as the photoconductive layer.

Xerography, as originally described in U.S. Pat. No. 2,297,691 to Carlson and later related patents, generally includes the steps of charging a photoconductive insulating member to sensitize it and then subjecting the photoconductive member to a light image or other pattern of activating electromagnetic radiation which serves to dissipate charge in radiation struck areas, thus leaving a charge pattern or latent electrostatic image on the photoconductor conforming to the radiation pattern. In most instances, the exposure step is made utilizing an expensive lens system. Following exposure, the image is developed by the deposition of electrostatically attractable, finely divided, colored material, referred to as toner, on the exposed photoconductor thereby forming a toner image corresponding to the latent electrostatic image. The toner image is subsequently transferred to a copy sheet which is generally plain paper.

Subsequent to the original contribution made by Carlson, a reflex type exposure technique was disclosed in several patents referred to hereinafter in the prior art section of this application. These reflex exposure methods have not become of commercial significance for several reasons. Initally, the structure of the photoconductive member was complex in order to achieve the required transparency necessary to render the imaging member operative. Secondly, because of the complex structure of the imaging member, it was difficult to clean the residual electrostatographic toner remaining thereon, after the completion of each cycle. Further, the images obtained by utilizing the reflex exposure technique as described in the patent literature are limited with regard to the maximum density of solid reproduced image areas. Thus, because of these problems, the xerographic industry progressed in directions other than by reflex exposure.

With the advent of organic photoconductive materials, some of which have varying degrees of transparency, reflex exposure techniques appear in a more favorable light because of the simplicity of structure which can be employed when considered in conjunction with the organic semi-transparent photoconductors. However, a problem which exists in the use of a reflex exposure technique is that a significantly longer exposure time is generally required in order to expose the photoconductive member significantly to thereby impose on its surface a latent image suitable for development. Thus, a photoconductive material which has varying degrees of transparency because of its inherent nature, cannot merely be utilized in an exposure of the reflex type because the sensitivity of these materials and the transparency thereof is not sufficient for establishing the latent image within the time frame suitable for this purpose.

Accordingly, it is the primary object of the present invention to provide an improved reflex exposure imaging member which overcomes the problems mentioned above.

PRIOR ART STATEMENT

The following art appears to be relevant:

Byrne U.S. Pat. No. 2,917,385 Dec. 15, 1959
Davis et al U.S. Pat. No. 3,141,770 July 21, 1964
Fox U.S. Pat. No. 3,265,496 Aug. 9, 1966
Gramza et al U.S. Pat. No. 3,615,396 Oct. 26, 1971
Gramza U.S. Pat. No. 3,615,415 Oct. 26, 1971
Contois U.S. Pat. No. 3,671,233 June 20, 1972
Kryman U.S. Pat. No. 3,679,406 July 25, 1972
Horgan U.S. Pat. No. 4,078,925 Mar. 14, 1978

Byrne U.S. Pat. No. 2,917,385

A xerographic plate is disclosed having a transparent or translucent conductive support having a pattern of conductive opaque areas overlying the conductive support, each opaque area having a layer of photoconductive material overlying it. In operation, the photoconductive areas are electrically charged and placed against the sheet to be copied. Light is passed through the plate from the support side. Where the light strikes a black area of the sheet, it is largly absorbed. In the white areas, it is reflected into the photoconductive areas to thereby discharge these areas. The resulting electrostatic image is rendered visible by depositing electrostatically attractable material thereon.

Davis et al U.S. Pat. No. 3,141,779 and Fox U.S. Pat. No. 3,265,496

Both disclose a photoconductive composition including an arylamine and a pyrylium, thiapyrylium or selenapyrylium salt. These materials may be incorporated in a binder.

Gramza et al U.S. Pat. No. 3,615,396

Discloses a method of forming a photoconductive composition by dissolving a dye in a solvent and adding thereto an electrically insulating pigment to form a heterogeneous photoconductive composition.

Gramza U.S. Pat. No. 3,615,415

Discloses a method of making a heterogeneous photoconductive composition by subjecting a solution of dye and polymer to high speed shearing and forming a coating of the sheared solution.

Contois U.S. Pat. No. 3,671,233

Discloses an electrophotographic element including a photoconductive composition which exhibits an absorption shift upon heating by the release of an alkali release material which shifts the absorption of sensitizers contained in the photoconductive composition.

Kryman U.S. Pat. No. 3,679,406

Relates to heterogeneous photoconductive compositions formed by dissolving a dye in a solvent, adding polymer and photoconductor, subjecting the thus formed dope to low temperature for a period of time, warming the dope and coating on a support.

Horgan U.S. Pat. No. 4,078,925

Is directed to an imaging member including a first layer of electrically active charge transport material on a substrate, a photoconductive layer overlying said active layer, a second layer of electrically active charge transport material overlying the photoconductive layer, the photoconductive layer exhibiting the capability of photogeneration of charge carriers and injection of charge carriers.

SUMMARY OF THE INVENTION

In accordance with this invention, there is provided a reflex exposure imaging member having a transparent conductive support member and a photoconductive layer disposed on the conductive support member and disposed between the two is an optical screen. The photoconductive layer comprises a compound having the formula:

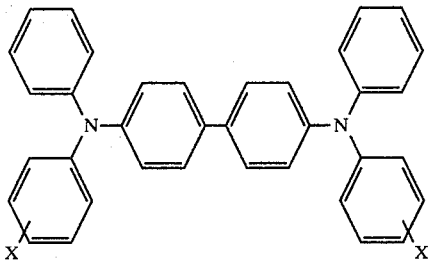

where X is an alkyl group having 1 to 4 carbon atoms or chlorine and a pyrylium, thiapyrylium or selenapyrylium salt present in an amount such that the photoconductive layer, when having a thickness of from about 5 to 20 microns, will have an optical density of from about 0.1 to about 0.8.

Thus, the invention contemplates a reflex exposure imaging member wherein the photoconductive layer includes a compound as set forth above, generally, in a binder which is a polymeric material in an amount sufficient to render the layer photoconductive. It is preferred that the photoconductive material, in accordance with the formula set forth above, is included in the polymeric binder in an amount close to the maximum quantity that will be dissolved therein. It has been found that the materials, in accordance with that indicated above, are more soluble in most polymeric resinous materials and, therefore, give improved results when incorporated into a photoconductive layer in a reflex exposure type imaging member. Generally, an amount of the benzidine compound, in accordance with the formula, from about 0.1 to 1.0 parts per part of resinous binder material is employed. Preferably, the amount of benzidine is from about 0.5 to about 1.0 parts per part of resinous binder employed.

The invention will be further described in connection with the accompanying drawing wherein a reflex exposure imaging member is shown schematically in cross-section.

The FIGURE illustrates a cross-sectional view of an imaging member 11 in accordance with this invention. The imaging member 11 comprises a substrate 13 which is either itself conductive or bears on one surface thereof a conductive film 15. Adjacent the conductive film 15 is disposed a photoconductive layer 17. The photoconductive layer 17 has incorporated into the surface adjacent the conductive layer 15 an optical screen 19.

The substrate 13 is of a material transparent to the energy to which the photoreceptor is sensitive. In this regard, the substrate should have a transmissivity to such wavelengths of at least about 50%. Any suitable material having these characteristics may be used, such as, for example, Mylar, glass, polyethylene, polypropylene, polyvinylfluoride, polycarbonate, polystyrene and the like. The general shape of the substrate may take the form of a flat plate, a continuous belt, a cylinder or the like depending upon the design characteristics of the device in which the method in accordance with this invention is to be carried out. The substrate must either be conducting in and of itself or bear on one surface thereof a conductive transparent layer. The substrate can be conductive of itself by adding to any of the materials mentioned above suitable conductive particles which will not appreciably effect the transmissivity of the substrate. Further, the substrate may be of a polymer which inherently has conductive characteristics such as some polymers known in the art which include within their molecular structure various salt-type groups which render them conductive.

Where a separate conductive layer such as shown at 15 is employed, any suitable conductive material which also has sufficient transparent characteristics may be employed such as, for example, thin layers of metallic substances such as chromium, aluminum, gold, tin, copper, silver and the like. Any suitable thickness of metallic film which permits the transmission of energy to which the photoreceptor is sensitive may be employed. A thickness of from about 1 to about 200 Angstroms is generally satisfactory for this purpose. In addition to these materials, a tin oxide, indium oxide layer or a copper iodide layer may be employed. A particularly suitable combination is a glass substrate having a tin oxide conductive layer disposed thereon manufactured by Pittsburgh Plate Glass Company under the name "NESA" glass. Adjacent the conductive layer 15, as shown is optical screen 19 and photoreceptor layer 17. It is to be understood that the optical screen 19, while shown integral with photoreceptive layer 17 may comprise a separate layer positioned between the light source and the photoreceptive layer 17 as close as possible to the photoreceptor. The optical screen 19 may have any desirable configuration, such as, for example parallel lines, cross-hatched parallel lines which form a mesh screen pattern, dots, ellipses, squares, diagonally disposed parallel lines, and the like. The optical screen 19 may have a repetitive pattern to form from about 100 to 1,000 lines per lineal inch and preferably from about 250 to about 1,000 lines per lineal inch. Most preferably, the optical screen 19 should be such as to form from about 300 to about 500 lines per lineal inch. In addition, the ratio of transparent areas to opaque areas of the optical screen will vary from about 20% to about 90%, preferably from about 40% to about 60% and, more preferably, equal areas of opaque and clear areas will be present.

The optical screen 19 may be fabricated of any suitable opaque material such as, for example, carbon black, aluminum, copper, gold, silver, chromium and the like. The optical screen 19 may be formed by any suitable technique well known in the art such as, for example, silver halide development, photoetching, silk screening, evaporating through a mask, machining and the like. A suitable commercially available electroformed copper, nickel or nickel plated copper grids available from C. O. Jelliff Mfg. Corp. under the trademark LEKTROMESH may be used herein as the optical screen 19. It is preferred that the optical screen 19 have sharply defined transparent and opaque areas and that it be of a reflective material in order to provide for multiple reflections within the photoreceptive material.

In operation, the imaging member of the figure is uniformly charged by any suitable means well known in the xerographic art, such as, for example corona wire, bias roller, rubbing or the like. Any suitable charging voltage may be employed; however, it is preferred that the charging voltage produces internal fields from about 10 to about 60 volts per micron thickness and preferably from about 15 to about 40 volts per micron thickness of the photoconductive layer.

The document 23 to be copied is now placed adjacent the free surface of the photoconductive layer 17 as shown, and exposed to a suitable light source. The light source may be a point source, a line source or collimated light. Where a noncollimated light source is employed, the spacing between the original document and the photoreceptor should preferably be no greater than four times the cycling period of the screen, the period being defined as the distance between two adjacent opaque screen members (i.e. dots, lines, etc.). Because of the divergent nature of the light source, the definition of the charge pattern resulting from the exposure will decrease as the distance between the original document and the photoreceptor 17 increases. The light rays 21 pass sequentially through the substrate 13, the conductive layer 15 and the photoreceptive layer 17 in the clear or open spaces of the screen 19. Where the light rays 21 impinge upon the opaque portions of screen 19, they are prevented from proceeding further into the imaging member. In the white areas of the original document 23, the light rays are reflected in substantially all directions because of the microscopically rough surface of the document, which is usually paper, and in these white areas, the photoconductive layer 17 is uniformly and completely discharged even behind the opaque areas of the optical screen 19. In the image containing areas of the original document 25 shown as the black portion in the figure, the light rays are substantially completely absorbed. Thus, the charge on the photoconductive conductive layer 17 immediately behind the opaque areas of the optical screen remains and is present in the form of a periodic charge pattern, which may be developed by standard techniques.

The photoconductive layer 17, as shown in the figure, incorporates within the surface adjacent the conductive layer 15 the optical screen 19. The photoconductive layer 17 includes a polymeric binder material having incorporated therein a photoconductive substance having the formula:

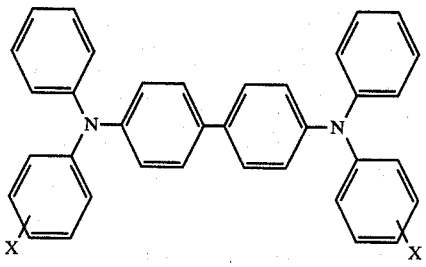

wherein X is an alkyl group having 1 to 4 carbon atoms, such as, for example, methyl, ethyl, propyl, isopropyl, isobutyl, tertiary, butyl, n-butyl, or chlorine. The substituent may be on the benzene ring in the ortho, meta, or para position. Typical compounds within the generic formula represented above are, for example, N,N'-diphenyl-N,N'-bis(methylpentyl)benzidine, N,N'-diphenyl-N,N'-bis(ethylphenyl)-benzidine, N,N'-diphenyl-N,N'-bis(propylphenyl)-benzidine, N,N'-diphenyl-N,N'-bis(butylphenyl)-benzidine, N,N'-diphenyl-N,N'-bis(isopropylphenyl)-benzidine, N,N'-diphenyl-N,N'-bis(secondary butylphenyl)-benzidine, N,N'-diphenyl-N,N'-bis(tertiary butylphenyl)-benzidine and the compound N,N'-diphenyl-N,N'-bis(chlorophenyl)-benzidine. The photoconductive benzidine compound is incorporated into the binder material as close to the maximum amount therein with respect to solubility in the resinous binder material as possible. This generally is in an amount of from about 0.1 to about 1.0 parts per part of the resinous polymeric binder material. It is preferred that it be incorporated in an amount from about 0.5 to about 1.0 parts per part of polymeric resinous binder material.

Any suitable resinous binder material having a high transparency with respect to the wavelength of light employed in the reflex exposure process may be used in the capacity of the binder material for the materials employed herein such as, for example, polycarbonate polymers, polyacrylic esters and polymethacrylic esters such as, for example, poly(methyl methacrylate), poly(n-butyl methacrylate), and the like; styrene alkyd resins; silicone resins; polyvinyl chloride and polyvinylidene chloride polymers; polyvinyl acetate; copolymers of ethylenically unsaturated monomers such as, for example, vinyl toluene, vinyl acetate, acrylic acid, methacrylic acid, vinyl chloride, vinylidene chloride, and the like; polystyrene; polyesters such as phthalic acid esters, terephthalic acid esters, and the like, polyamides and the like. It is preferred that the resinous binder material used in accordance with this invention is a polycarbonate polymer.

Also incorporated into the benzidine-resinous binder composition is a pyrylium or thiapyrylium salt such as those represented by the following general formula:

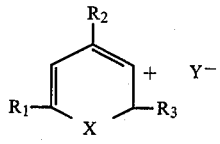

wherein $R_1$, $R_2$ and $R_3$ may each represent an aliphatic group having from 1 to 15 carbon atoms, such as methyl, ethyl, propyl, isopropyl, butyl, isobutyl tertiary butyl, amyl, isoamyl, hexyl, octyl, nonyl, dodecyl, vinyl, styryl, alkoxy-styryl, diethoxystyryl, dimethylaminostyryl, 1-butyl-4-p-dimethylaminophenyl-1,3-butadienyl, β-ethyl-4-dimethyl-aminostyryl; an alkoxy group such as methoxy, ethoxy, propoxy, butoxy, amyloxy, hexoxy, octoxy, etc.; aryl, such as phenyl, 4-biphenyl, alkphenyl, such as 4-ethylphenyl, 4-propylphenyl, etc., alkoxyphenyl, e.g., 4-ethoxyphenyl, 4-methoxyphenyl, 4-amyloxyphenyl, 2-hexoxyphenyl, 2-methoxyphenyl, 2-amyloxyphenyl, 3,4-dimethoxyphenyl, etc.; ω-hydroxy alkoxyphenyl, e.g., 2-hydroxyethoxyphenyl, 3-hydroxyethoxyphenyl, etc., 4-hydroxyphenyl, halophenyl, e.g., 3,4-dichlorophenyl, 3,4-dibromophenyl, chlorophenyl, 2,4-dichlorophenyl, etc., azidophenyl, nitrophenyl, etc., aminophenyl, e.g., 4-diethylaminophenyl, 4-dimethylaminophenyl, etc.; X is a hetero atom, such as oxygen, sulfur and selenium; and Y is an anionic function.

Typical members of the present pyrylium and thiapyrylium salts include the following: 2,4,6-Triphenylpyrylium perchlorate, 4-(4-Methoxyphenyl)-2,6-diphenylpyrylium perchlorate, 4-(2,4-Dichlorophenyl)-2,6-diphenylpyrylium perchlorate, 4-(3,4-Dichlorophenyl)-2,6-diphenylpyrylium perchlorate, 2,6-Bis(4-methoxyphenyl)-4-phenylpyrylium perchlorate, 6-(4-Methoxyphenyl)-2,4-diphenylpyrylium perchlorate, 2-(3,4-Dichlorophenyl)-4-(4-methoxyphenyl)-4-phenylpyrylium perchlorate, 4-(4-Amyloxyphenyl)-2,6-bis(4-ethylphenyl)pyrylium perchlorate, 4-(4-Amyloxyphenyl)-2,6-bis(4-methoxyphenyl)pyrylium perchlorate, 2,4,6-Triphenylpyrylium fluoborate, 2,6-Bis(4-ethylphenyl)-4-(4-methoxyphenyl)pyrylium perchlorate, 2,6-Bis(4-ethylphenyl)-4-(4-methoxyphenyl)-pyrylium fluoborate, 6-(3,4-Diethoxystyryl)-2,4-diphenylpyrylium perchlorate, 6-(3,4-Diethoxy-β-amylstyryl)-2,4-diphenylpyrylium fluoborate, 6-(3,4-Dimethylamino-β-ethylstyryl)-2,4-diphenylpyrylium fluoborate, 6-(1-n-Amyl-4-p-dimethylaminophenyl-1,3-butadienyl)-2,4-diphenylpyrylium fluoborate, 6-(4-Dimethylaminostyryl)-2,4-diphenylpyrylium fluoborate, 6-(α-Ethyl-β-β-dimethylaminophenyl vinylene)-2,4-diphenylpyrylium fluoborate, 6-(1-Butyl-4-p-dimethylaminophenyl-1,3-butadienyl)-2,4-diphenylpyrylium fluoborate, 6-(4-Dimethylaminopyryl)-2,4-diphenylpyrylium perchlorate, 6-[β,β-Bis(4-dimethylaminophenyl)vinylidene]-2,4-diphenylpyrylium perchlorate, 2,6-Bis(4-dimethylaminostyryl)-4-phenylpyrylium perchlorate, 6-(β-Methyl-4-dimethylaminostyryl)-2,4-diphenylpyrylium fluoborate, 6-(1-Ethyl-4-p-dimethylaminophenyl-1,3-butadienyl)-2,4-diphenylpyrylium fluoborate, 6-[β,β-Bis(4-dimethylaminophenyl)-vinylidene]-2,4-diphenylpyrylium fluoborate, 6-(1-Methyl-4-p-dimethylaminophenyl-1,3-butadienyl)-2,4-diphenylpyrylium fluoborate, 4-(4-Dimethylaminophenyl)-2,6-diphenylpyrylium perchlorate, 2,6-Bis(4-ethylphenyl)-4-phenylpyrylium perchlorate, 2,6-Bis(4-ethylphenyl)-4-methoxyphenylthiapyrylium fluoborate, 2,4,6-triphenylthiapyrylium perchlorate, 4-(4-Methoxyphenyl)-2,6-diphenylthiapyrylium perchlorate, 6-(4-Methoxyphenyl)-2,4-diphenylthiapyrylium perchlorate, 2,6-Bis(4-methoxyphenyl)-4-phenylthiapyrylium perchlorate, 4-(2,4-Dichlorophenyl)-2,6-diphenylthiapyrylium perchlorate, 2,4,6-Tri(4-methoxyphenyl)-thiapyrylium perchlorate, 2,6-Bis(4-ethylphenyl)-4-phenylthiapyrylium perchlorate, 4-(4-Amyloxyphenyl)-2,6-bis(4-ethylphenyl)thiapyrylium perchlorate, 6-(4-Dimethylaminostyryl)-2,4-diphenylthiapyrylium perchlorate, 2,4,6-Triphenylthiapyrylium fluoborate, 2,4,6-Triphenylthiapyrylium sulfate, 4-(4-Methoxyphenyl)-2,6-diphenylthiapyrylium fluoborate, 2,4,6-triphenylthiapyrylium chloride, 2-(4-Amyloxyphenyl)-4,6-diphenylthiapyrylium fluoborate, 4-(4-Amyloxyphenyl)-2,6-bis(4-methoxyphenyl)thiapyrylium perchlorate, 2,6-Bis(4-ethylphenyl)-4-(4-methoxyphenyl)-thiapyrylium perchlorate, 4-Anisyl-2,6-bis(4-n-amyloxyphenyl)thiapyrylium chloride, 2-[β,β-Bis(4-dimethylaminophenyl)vinylene]-4,6-diphenylthiapyryliyum perchlorate, 6-(β-Ethyl-4-dimethylaminostyryl)-2,4-diphenylthiapyrylium perchlorate, 2-(3,4-Diethoxystyryl)-4,6-diphenylthiapyrylium perchlorate, 2,4,6-Trianisylthiapyrylium perchlorate, 6-Ethyl-2,4-diphenylpyrylium fluoborate, 2,6-Bis(4-ethylphenyl)-4-(4-methoxyphenyl)thiapyrylium chloride, 6-[β,β-Bis(4-dimethylaminophenyl)vinylene]-2,4-di(4-ethylphenyl)-pyrylium perchlorate, 2,6-Bis(4-amyloxyphenyl)-4-(4-methoxyphenyl)thiapyrylium perchlorate, 6-(3,4-Diethoxy-β-ethylstyryl)-2,4-diphenylpyrylium fluoborate, 6-(4-Methoxy-β-ethylstyryl)-2,4-diphenylpyridium fluoborate, 2-(4-ethylphenyl)-4,6-diphenylthiapyrylium perchlorate, 2,6-diphenyl-4-(4-methoxyphenyl)-thiapyrylium perchlorate, 2,6-diphenyl-4-(4-methoxyphenyl)thiapyrylium fluoborate, 2,6-bis(4-ethylphenyl)-4-(4-n-amyloxyphenyl)-thiapyrylium perchlorate, 2,6-bis(4-methoxyphenyl)-4-(4-n-amyloxyphenyl)-thiapyrylium perchlorate, 2,4,6-tri(4-methoxyphenyl)-thiapyrylium fluoborate, 2,6-diphenyl-6(3,4-diethoxystyryl)pyrylium perchlorate, 4-(4-diethylaminophenyl)-2,6-diphenylthiapyrylium fluoborate, and the like.

The quantity of the thiapyrylium salt added to the benzidine-polymeric resinous binder composition is dependent upon a number of factors. The first is the transparency of the photoconductive layer. The photoconductive layer, in order to operate satisfactorily in the reflex exposure imaging member in accordance with this invention, must have an optical density of 0.1 to 0.8. The photoconductive layer itself, in order to hold the charges suitable for proper development in a xerographic process, must have a thickness of about 5 to 20 microns. Therefore, the quantity of the pyrylium compound is incorporated within the photoconductive composition in an amount to achieve the required optical density of the photoconductive layer at the thickness necessary for the photoconductive layer. Generally, the pyrylium compound will be included in the benzidene compound in an amount from about 0.001 to about 10 percent based on the weight of the benzidine compound employed and preferably from about 0.01 percent to about 1.0 percent based on the weight of the benzidine compound. The optical density of a film is readily determined by using a spectrophotometer which will record either optical density directly or the percent of any particular wavelengths desired which is transmitted thereby. In the case of an apparatus which indicates the percent transmission, the optical density is determined by the log of the reciprocal of the transmission.

The invention will be further illustrated by the following examples in which parts are by weight unless otherwise specified.

EXAMPLE I

About 1 part of N,N'-diphenyl-N,N'-bis(methylphenyl)benzidine is dissolved in about 20 parts by volume of methylene chloride and this is added to about 1 part of a polycarbonate polymer and stirred until a solution of the polycarbonate and the benzidine compound in the methylene chloride is formed. To this is added about 0.005 part of 4-(4-diethylaminophenyl)-2,6-diphenylthiapyrylium fluoborate. This solution is then coated utilizing a doctor blade coating technique unto a glass plate having thereon a stannous oxide conductive coating sold under the trademark NESA by Pittsburg Plate Glass Company. The coating is applied in different thicknesses to a number of plates in order to achieve varying thicknesses of the photoconductive layers of from about 5 to about 20 microns. The plates are dried in an oven at about 50° C. for about 2 hours in order to remove the solvent. The completed photoconductive layers exhibit optical densities ranging from 0.1 to 0.8. It was found that the coatings having an optical density of from about 0.2 to about 0.4 were preferred because of the sensitivity with respect to reflex imaging. Plates made at coating thicknesses without the range of 0.1 to 0.8 were unsatisfactory either because they did not absorb sufficiently or they were not sufficiently transparent.

EXAMPLE II

Example 1 is repeated utilizing about 0.1 part of N,N'-diphenyl-N,N'-bis(methylphenyl)benzidine to one part of polycarbonate. The thiapyrylium fluoborate compound is then added in an amount of 0.0001 part. Glass plates having a conductive coating are coated in various thicknesses to achieve optical densities within the range of 0.1 to 0.8.

EXAMPLE III

About 0.5 part of N,N'-diphenyl-N,N'-bis(chlorophenyl)benzidine is dissolved in 30 parts by volume benzene and to this solution is added 1 part of poly(methyl methacrylate). Stirring is continued until a solution is formed. To this is added 0.05 part of 2,6-diphenyl-4-(4-methoxyphenyl)-thiapyrylium perchlorate in 10 parts by volume of a mixture of equal parts of cyclohexanone and methyl alcohol. This solution is applied in varying thicknesses to a number of glass plates which are then dried to achieve photosensitive plates having an optical density between 0.1 and 0.8 and which exhibit excellent images when exposed by reflex exposure techniques.

EXAMPLE IV

The procedure of Example 3 is repeated with the exception that N,N'-diphenyl-N,N'-bis(butylphenyl)benzidine is used herein. Again, satisfactory images are produced by reflex exposure when the substrates are coated to a thickness yielding an optical density between 0.1 and 0.8.

EXAMPLE V

A substrate is prepared by evaporating aluminum in the form of a cross-hatched grid pattern of 500 lines per lineal inch in each direction, the pattern having a transparent area of 50%, onto glass having thereon a NESA conductive coating. A 10 micron thick layer of a photoconductive composition, prepared by dissolving about 0.01 part of 4-anisyl-2,6-diphenylthiapyrylium perchlorate in about 1.5 parts of a mixture of equal parts of cyclohexanone and methyl alcohol and adding to this solution about 1 part of N,N'-diphenyl-N,N'-bis(methylphenyl)benzidine in 15 parts of 1,2-dichloropropane containing about 2 parts of polystyrene, is applied to the thus prepared substrate by doctor blade. The coating is dried by insertion in an oven at 50° C. for 2 hours. The free surface of the photoconductive imaging member is charged to a negative 300 volts by corona discharge and a document to be copied is placed face down on the surface. Exposure is made through the substrate side of the imaging member. The document is removed and the latent image is toned and transferred to paper. A reproduction of exceptional quality results.

It is to be understood that the examples are for the purpose of illustration and are not intended as the sole method of carrying out the invention claimed herein. Other embodiments will be apparent to those skilled in the art without departing from the spirit and scope of the appended claims.

I claim:

1. A reflex exposure imaging member comprising a transparent conductive support member, a photoconductive layer disposed on said conductive support member and an optical screen disposed between said photoconductive layer and said support member, said photoconductive layer comprising an insulating resinous binder material containing from about 0.1 to about 1 part by weight of a benzidine compound per part of insulating resinous binder material and having the formula:

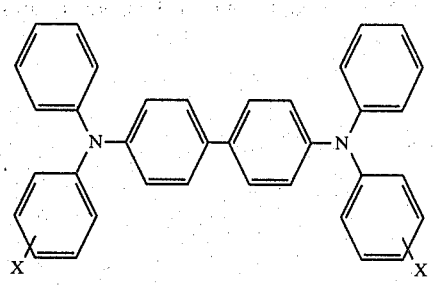

where X is a member selected from the group consisting of alkyl having 1 to 4 carbon atoms, resinous binder, and about 0.001 to 10 salts percent by weight, based on the weight of the benzidine compound, of a salt selected from the group consisting of pyrylium salts, thiapyrylium salts and selenapyrylium salts, said photoconductive layer having a thickness of from about 5 to about 20 microns and an optical density of from about 0.1 to about 0.8.

2. The imaging member of claim 1 wherein the salt is present in an amount of from about 0.01 percent to about 1 percent based on the weight of the benzidine compound.

3. The imaging member of claim 2 wherein the salt is present in an amount of 0.5 percent based on the weight of the benzidine compound.

4. The imaging member of claim 1 wherein the salt is a pyrylium salt.

5. The imaging member of claim 1 wherein the salt is a thiapyrylium salt.

6. The imaging member of claim 5 wherein the thiapyrylium salt is 4-(4-diethylaminophenyl)-2,6-diphenylthiapyrylium.

7. The imaging member of claim 1 wherein the benzidine compound is N,N'-diphenyl-N,N'-bis(methylphenyl)benzidine.

8. The imaging member of claim 1 wherein the benzidine compound is N,N'-diphenyl-N,N'-bis(methylphenyl)benzidine and is present in an amount of from about 0.5 to 1 part per part of insulating resinous binder, the binder is a polycarbonate resin and the salt is a thiapyrylium salt present in an amount of from about 0.01 percent to about 1 percent based on the weight of the benzidine compound.

9. A reflex imaging member in accordance with claim 1 wherein the conductive support member is comprised of a polymer having added thereto a conductive material.

10. A reflex imaging member in accordance with claim 9 wherein the conductive material is a metallic substance.

11. A reflex imaging member in accordance with claim 10 wherein the metallic substance is selected from chromium, aluminum, gold, tin, copper or silver.

12. A reflex imaging member in accordance with claim 9 wherein a conductive material is deposited on a polymer in a thickness of from about 1 to about 200 Angstroms.

13. A reflex imaging member in accordance with claim 1 wherein the thiapyrylium salt is 4-(4-diethylaminophenyl)2,6-diphenylthiapyrylium fluoborate.

14. A reflex imaging member in accordance with claim 1 wherein the thiapyrylium salt is 2,6-diphenyl-4-(4-methoxyphenyl)-thiapyrylium perchlorate.

15. A reflex imaging member in accordance with claim 1 wherein the thiapyrylium salt is 4-anisyl-2,6-diphenylthiapyrylium perchlorate.

16. A reflex imaging member in accordance with claim 1 wherein the benzidine compound is N,N'-diphenyl-N,N'-bis(butylphenyl)benzidine.

* * * * *